US010947470B2

(12) United States Patent
McCleary

(10) Patent No.: US 10,947,470 B2
(45) Date of Patent: Mar. 16, 2021

(54) COMPOSITE WATERPROOF FIRE STARTING PUCK

(71) Applicant: Innovative Concepts, LLC, Arvada, CO (US)

(72) Inventor: Diana McCleary, Arvada, CO (US)

(73) Assignee: Innovative Concepts, LLC, Arvada, CO (US)

( * ) Notice: Subject to any disclaimer, the term of this patent is extended or adjusted under 35 U.S.C. 154(b) by 0 days.

(21) Appl. No.: 16/599,778

(22) Filed: Oct. 11, 2019

(65) Prior Publication Data

US 2020/0115646 A1 Apr. 16, 2020

Related U.S. Application Data

(60) Provisional application No. 62/745,644, filed on Oct. 15, 2018.

(51) Int. Cl.
*C10L 11/04* (2006.01)
*C10L 11/06* (2006.01)

(52) U.S. Cl.
CPC ..... *C10L 11/04* (2013.01); *C10L 11/06* (2013.01); *C10L 2270/08* (2013.01)

(58) Field of Classification Search
CPC ..... C10L 11/04; C10L 11/06; C10L 2270/08
See application file for complete search history.

(56) References Cited

U.S. PATENT DOCUMENTS

| | | | | |
|---|---|---|---|---|
| 1,767,293 | A | 6/1930 | Krei et al. | |
| 1,817,458 | A * | 8/1931 | Munchow | C10L 11/04 44/490 |
| 3,927,993 | A | 12/1975 | Griffin | |
| 4,725,286 | A | 2/1988 | Brame | |
| 8,647,399 | B2 | 2/2014 | Reddy et al. | |
| 9,932,537 | B2 | 4/2018 | Schunk | |
| 2007/0044376 | A1 | 3/2007 | Monin | |
| 2008/0172930 | A1 | 7/2008 | Breuer et al. | |
| 2017/0226440 | A1 * | 8/2017 | Fandrich | C10L 11/04 |

* cited by examiner

*Primary Examiner* — Cephia D Toomer
(74) *Attorney, Agent, or Firm* — Trenner Law Firm, LLC; Mark D. Trenner

(57) ABSTRACT

An example composite waterproof fire starting puck includes a base of paraffin wax, a quantity of dried waterproof or hydrophobic moss embedded in, and surrounding, the paraffin wax, and a quantity of combustible material(s) embedded in, and projecting out of, the paraffin wax. An example composite waterproof fire starting puck may also include a wax cover. An example composite waterproof fire starting puck may also include flammable organic herbs or fragrant material(s) to provide a desirable smell during burning. When a spark or small flame is applied to the moss, the moss ignites, and after the moss ignites, the moss releases sufficient heat to ignite the quantity of combustible material(s) to melt and ignite the paraffin.

20 Claims, 6 Drawing Sheets

COMPOSITE WATERPROOF FIRE STARTING PUCK

CROSS REFERENCE TO RELATED APPLICATIONS

This application claims the priority benefit of U.S. Provisional Patent Application No. 62/745,644 filed Oct. 15, 2018 for "Composite Waterproof fire starting puck," hereby incorporated by reference in its entirety as though fully set forth herein.

BACKGROUND

Fire starters come in a variety of shapes and forms. Some have wicks, which often are not waterproof and may take an extended amount of time to light under adverse conditions. Many are advertised to be eco-friendly, but often leave much residue after burn tests. Many are claimed to be waterproof, but many of these do not burn after being submerged in water or dampened in water. If they do burn, it may be for only a short amount of time. Wind may also put out many fire starters.

DETAILED DESCRIPTION

An example composite waterproof fire starting puck is disclosed. The composite waterproof fire starting puck may be implemented to reliably start or light a fire under a variety of adverse conditions. For example, the composite waterproof fire starting puck is water resistant or even waterproof, wind resistant or even windproof, small, and lightweight.

An example of the composite waterproof fire starting puck is compact and lightweight for backpacking and the outdoors. The composite waterproof fire starting puck is cost effective and readily carried by outdoor enthusiasts, backpackers, and campers, among other end-users. The composite waterproof fire starting puck may be implemented for starting a campfire or cookout fire in a firepits, as well as in emergency and survival situations.

An example of the composite waterproof fire starting puck maintains a substantial sized flame, even in rainy or windy conditions. Indeed, an example of the composite waterproof fire starting puck can even float on water, and even after being completely submerged in water, burns for approximately 20 minutes or longer in the water. The composite waterproof fire starting puck may even continue to burn for an additional 15-25 minutes or more after being removed from water.

An example of the composite waterproof fire starting puck is manufactured of organic material and eco-friendly. All natural products are used, and therefore there are no harmful fumes or residue. If there is any residual material left over from the combustion of the composite waterproof fire starting puck, this material can be stirred to easily relight, until all residue is gone.

Before continuing, it is noted that as used herein, the terms "includes" and "including" mean, but is not limited to, "includes" or "including" and "includes at least" or "including at least." The term "based on" means "based on" and "based at least in part on."

Figure 1:
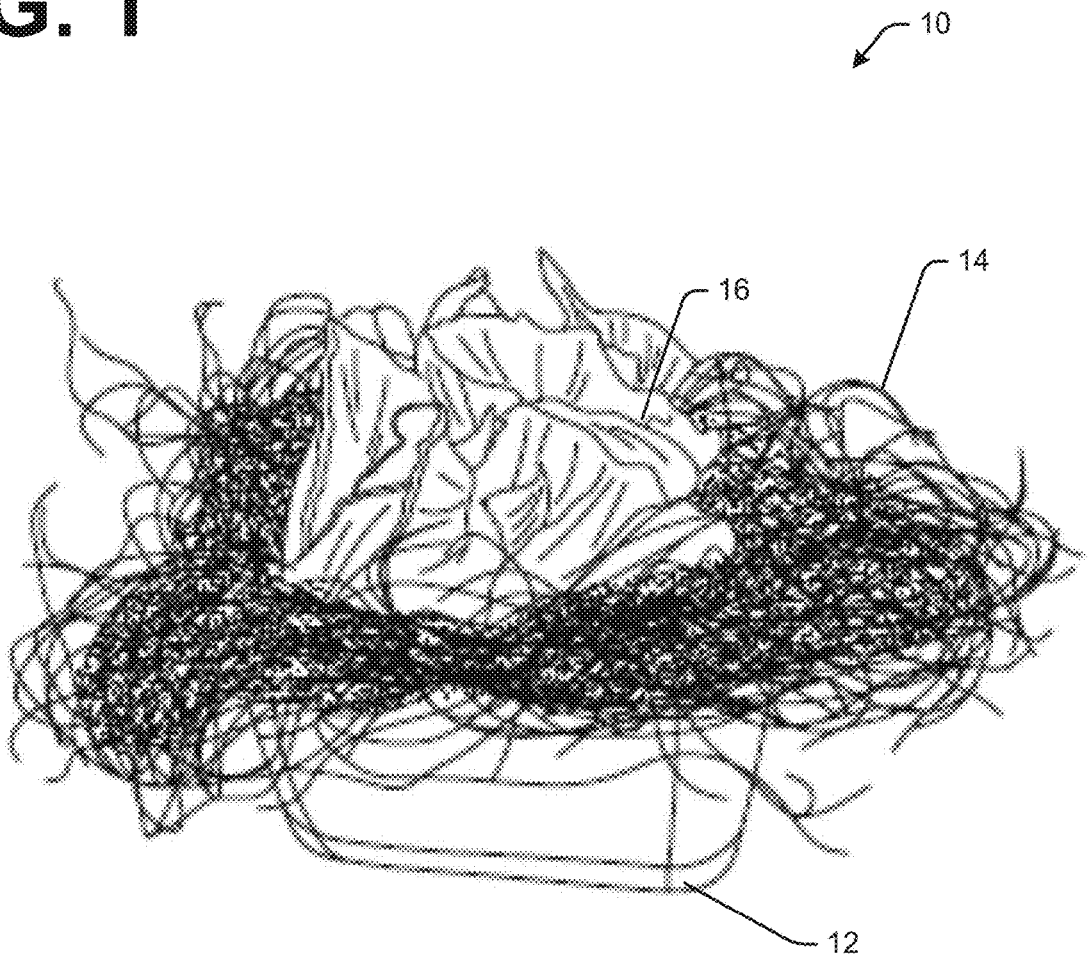
FIG. 1 is a top perspective view of an example composite waterproof fire starting puck.
Figure 2:
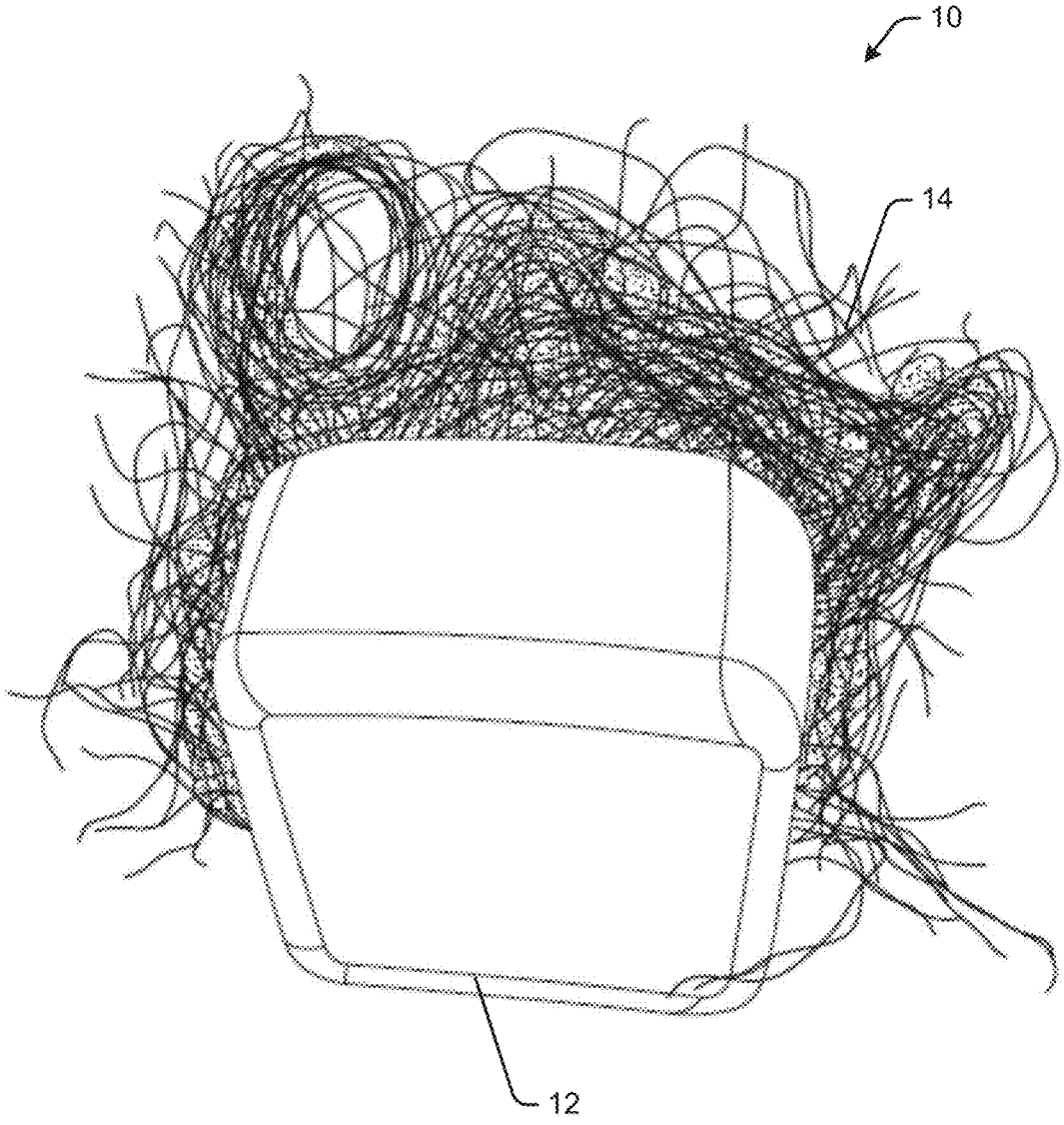
FIG. 2 is a bottom perspective view of the example composite waterproof fire starting puck of FIG. 1.
Figure 3:
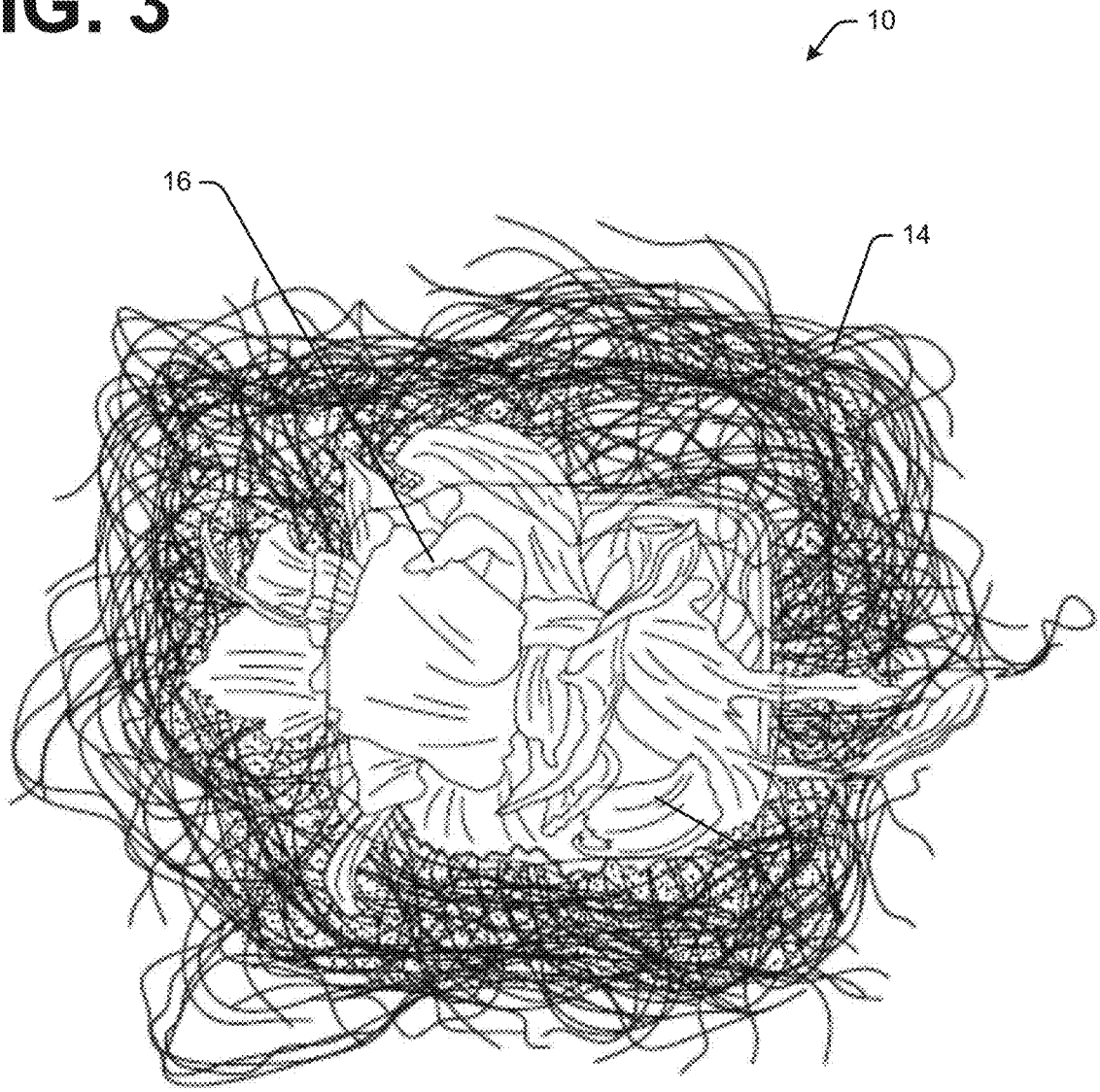
FIG. 3 is a bottom view of the example composite waterproof fire starting puck.

FIG. 1 is a top perspective view of an example composite waterproof fire starting puck 10. FIG. 2 is a bottom perspective view of the example composite waterproof fire starting puck 10 of FIG. 1. FIG. 3 is a bottom view of the example composite waterproof fire starting puck 10.

An example composite waterproof fire starting puck 10 includes a base of paraffin wax 12. The paraffin base may be about 1.5×1.5×1.5 cubic inches, or any other size that is desirable based on the end-use. For example, smaller devices may be more desirable for carrying along in survival situations, while larger devices may be provided by home use or camping where size is not a factor.

The example composite waterproof fire starting puck 10 also includes a quantity of dried waterproof or hydrophobic moss 14 embedded in, and surrounding, the paraffin wax 12. The example composite waterproof fire starting puck 10 also includes a quantity of combustible material(s) 16 embedded in, and projecting out of, the paraffin wax 12. In an example, the combustible material(s) 16 include at least one of paper and/or cardboard 20, and wood chips and/or wood dust of various sizes 21. A wax cover 24 may be melted over top.

During use, the combustible material(s) 16 serve as wicks for the paraffin wax 12 and help to regulate the rate of combustion of both the combustible material(s) 16 themselves, and the paraffin wax 12. When a spark or small flame is applied to the moss 14, the moss 14 ignites. After the moss 14 ignites, the moss 14 releases sufficient heat to ignite the quantity of combustible material(s) 16 to melt and ignite the paraffin 12.

In an example, composite waterproof fire starting puck 10 may also include other flammable organic herbs or other fragrant material(s) 22 to provide a desirable smell during burning of the device.

In an example, the composite waterproof fire starting puck 12 is configured for floating on water, and for igniting and burning while floating on water. For example, the paraffin wax 12 and/or 24 may be buoyant so as to both serve as floatation and waterproofing for the burnable material. In an example, the device is configured for igniting and burning after immersion in water or other exposure to water. In an example, the device is configured for burning for about 15-25 minutes while floating on water, and afterward is capable of burning for about an additional 15-25 minutes when removed from the water.

In an example, the composite waterproof fire starting puck 12 is configured for igniting during exposure to wind and continuing to burn during exposure to wind. For example, the moss 14 and paraffin wax 12 and/or 24 combination may serve as highly ignitable to provide a flame for the longer burning combustible material(s). In an example, the device is configured for burning with a sustained flame height of about 4 to 6 inches for at least about 12-16 minutes.

In an example, heat released by three or more instances of the device is sufficient to boil a cup of water or cook a small foil meal.

Figure 4:
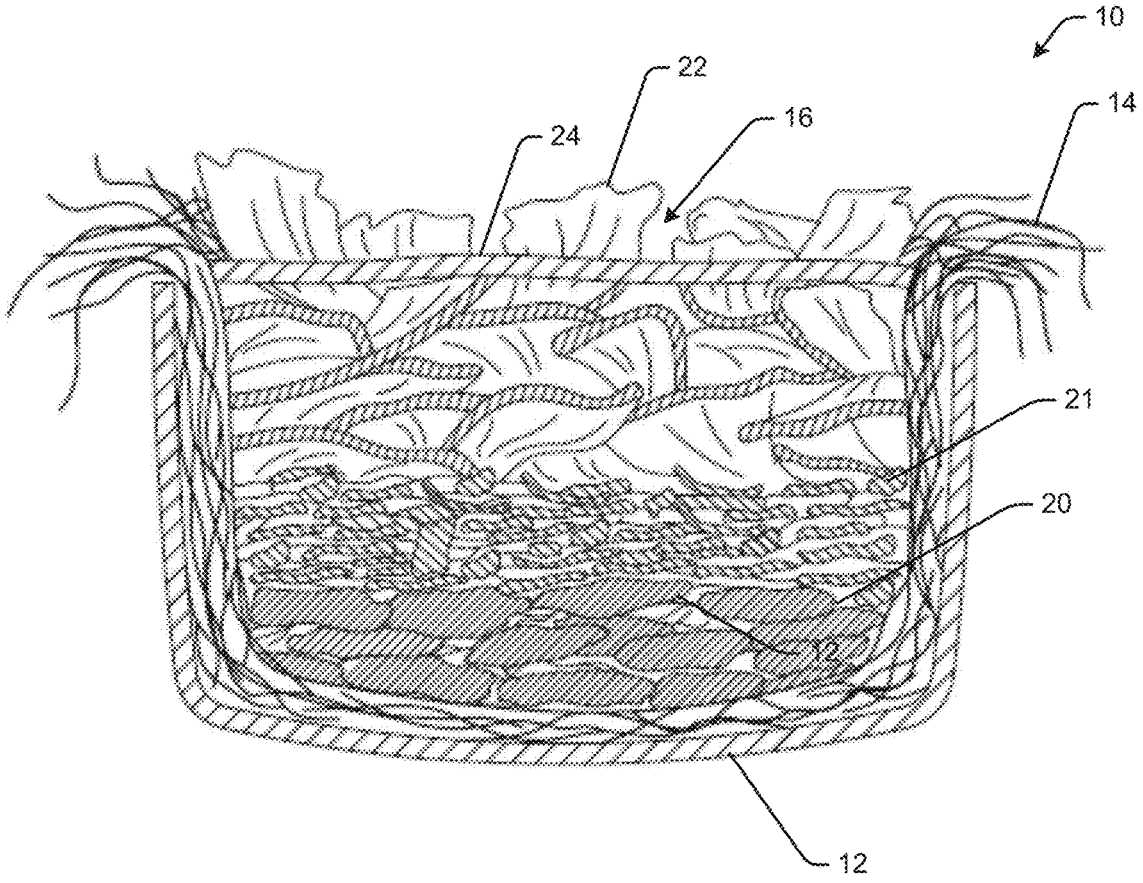
FIG. 4 is a side cross-sectional view of the example composite waterproof fire starting puck.

FIG. 4 is a side cross-sectional view of the example composite waterproof fire starting puck 10. Visible are the dried waterproof moss 14, paper and/or cardboard 20, red cedar or other wood chips or dust of various sizes 21, and a paraffin mixture (both the base 12 and the cover 24). In an example, the moss 14 forms a pocket for the other material 20-22. Because the moss 14 is waterproof or hydrophobic, it remains capable of ignition during or after exposure to, or even during or after immersion in water.

Before continuing, it should be noted that the examples described above are provided for purposes of illustration, and are not intended to be limiting. Other devices, material(s), steps, and/or configurations may be utilized to carry out the operations described herein. For example, the device is not limited to size or material.

Figure 5:
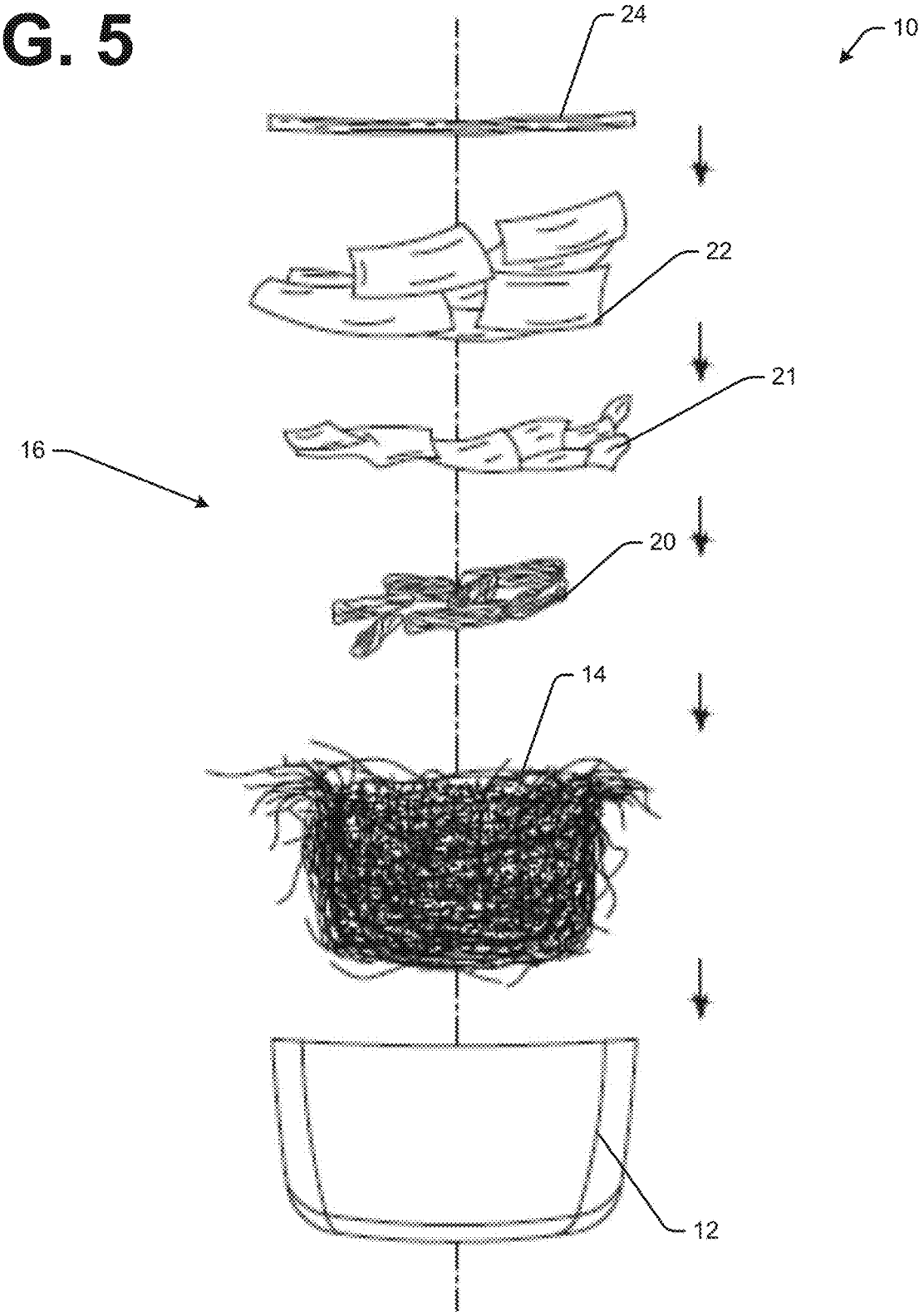
FIG. 5 is an exploded component view of the example composite waterproof fire starting puck.
Figure 6:
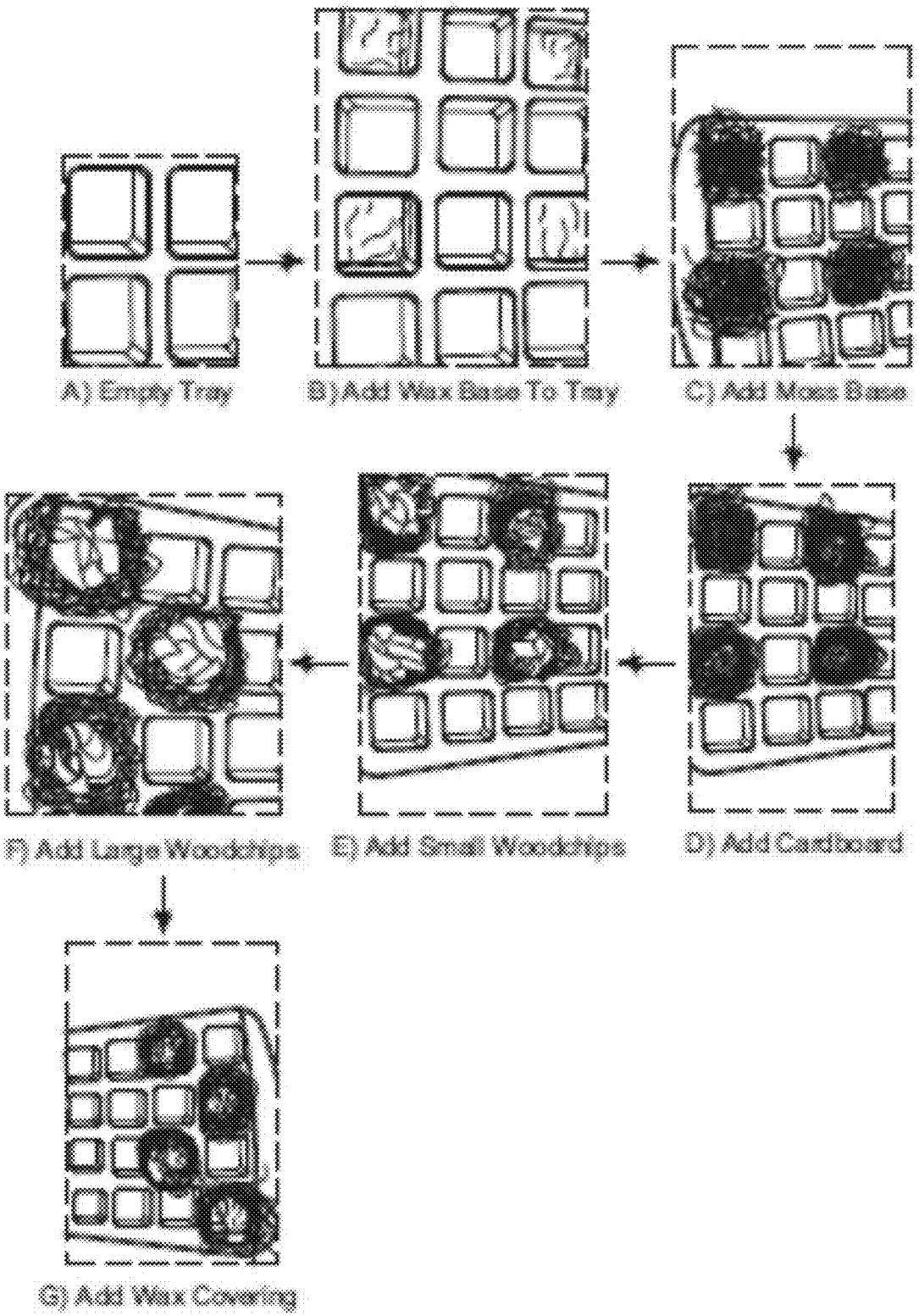
FIG. 6 illustrates an example method of manufacture of the example composite waterproof fire starting puck.

FIG. 5 is an exploded component view of the example composite waterproof fire starting puck 10. FIG. 6 illustrates an example method of manufacture of the example composite waterproof fire starting puck 10. Each of the composite waterproof fire starting pucks 10 may be individually crafted, professionally packaged, and sold individually and in mass.

In an example, the composite waterproof fire starting puck 10 is manufactured in cubic silicone tray holder (Step A in FIG. 6). Each depression may be about a 1.5"×1.5"×1.5" cube, although other sizes and shapes are also possible.

In an example, liquid paraffin wax is added to the depression (Step B in FIG. 6). In this example, the wax is added both before (Step B) and at the end (Step G). In another example liquid paraffin wax is added only at the end (Step G, omitting step B).

In an example, dried waterproof or hydrophobic moss 14 lines the sides of the cube (Step C in FIG. 6). The cube with moss is then filled with a mixture of recycled natural cardboard and/or paper product, red cedar wood chips, and red cedar sawdust (Steps D-F in FIG. 6).

In an example, a paraffin wax cover is then added to keep the ingredients in place and form a solid cube (Step G in FIG. 6). Although illustrated as a solid "plate" or cover 24 in FIG. 5, it is understood that the liquid form of the wax may cause it to flow down through some or all of the layers and/or into the moss 14.

In use, the example composite waterproof fire starting puck 10 ignites by application of a spark or small flame (e.g., from a lighter, match, or fire starter). The waterproof moss 14 that surrounds the composite waterproof fire starting puck is flammable, even after exposure to or immersion in water. Because the wax surrounds the puck, it tends to aid the entire puck in shedding water. The moss is typically the first element of the puck to ignite when exposed to a spark or small flame.

It is noted that any or all of the paper and/or cardboard 20, wood chips and/or sawdust 21, and moss 14 are all capable of serving as wicks, allowing combustion to proceed at a measured pace.

In an example, the moss on the burning side of the puck is substantially consumed. However, some moss continues to burn, and the temperature of this region on the puck has been elevated such that other elements of the composite waterproof fire starting puck 10 are now approaching their ignition point. For example, once the flame from the moss is lit, the flame hits the top of the composite waterproof fire starting puck 10, and elevates the temperature of the red cedar chips until they reach their ignition point.

When the cedar chips 20 have ignited, they provide sufficient heat to melt and ignite the paraffin. At this point, the flame spreads quickly and burns vigorously. The flame spreads and stays lit for a significant period of time. The composite waterproof fire starting puck can burn very hot (e.g., 12-16 minutes or more with a 4-6 inch high sustained flame). Even while floating on water, the the composite waterproof fire starting puck 10 can burn for 17-25 minutes and when removed from the water, can continue to burn an additional 15-25 minutes out of water. In testing, the composite waterproof fire starting puck has maintained a substantial sized flame even when wet and with wind.

In an example, multiple (e.g., three or more) pucks provide sufficient released heat to boil a cup of water, or to cook a small foil meal. If there is any residual material left over from the combustion of the composite waterproof fire starting puck 10, it can be stirred to easily relight the flame, until all of the residue is gone.

The operations (both method of manufacture, and method of use) shown and described herein are provided to illustrate example implementations. It is noted that the operations are not limited to the ordering shown. Still other operations may also be implemented.

It is noted that the examples shown and described are provided for purposes of illustration and are not intended to be limiting. Still other examples are also contemplated.

The invention claimed is:

1. A composite waterproof fire starting puck, comprising:

a base of paraffin wax;

a quantity of dried waterproof or hydrophobic moss embedded in, and surrounding, the paraffin wax; and a quantity of combustible material embedded in, and projecting out of, the paraffin wax and configured as wicks for the paraffin wax to regulate the rate of combustion of both the combustible material and the paraffin wax;

wherein when a spark or flame is applied to the moss, the moss ignites, and after the moss ignites, the moss releases sufficient heat to ignite the quantity of combustible material to melt and ignite the paraffin.

2. The composite waterproof fire starting puck of claim 1, wherein the combustible material include at least one of paper, cardboard, wood chips, and wood dust.

3. The composite waterproof fire starting puck of claim 1, further comprising a layering of the combustible material surrounded by the moss, the layering including woodchips and at least one of paper, cardboard, and wood dust.

4. The composite waterproof fire starting puck of claim 3, further comprising a wax cover over the layering.

5. The composite waterproof fire starting puck of claim 1, wherein the paraffin base is about 1.5×1.5×1.5 cubic inches.

6. The composite waterproof fire starting puck of claim 1, further comprising flammable organic herbs or fragrant material to provide a desirable smell during burning.

7. The composite waterproof fire starting puck of claim 1, wherein the base is configured for floating on water.

8. The composite waterproof fire starting puck of claim 7, wherein the base is configured for igniting and burning the moss and/or the combustible material while the base is floating on water.

9. The composite waterproof fire starting puck of claim 8, wherein the moss and/or the combustible material is provided in sufficient amount for burning up to about 15-25 minutes while floating on water, and afterward the moss and/or the combustible material still burns up to about an additional 15-25 minutes when removed from the water.

10. The composite waterproof fire starting puck of claim 1, wherein the base is configured for igniting and burning the moss and/or the combustible material after immersion in water or other exposure to water.

11. The composite waterproof fire starting puck of claim 1, wherein the base is configured to provide wind resistance while burning the moss and/or combustible material.

12. The composite waterproof fire starting puck of claim 1, wherein the base is configured for burning the moss and/or the combustible material with a sustained flame height of about 4 to 6 inches for at least about 12-16 minutes.

13. The composite waterproof fire starting puck of claim 1, wherein the base is configured to be combined with additional bases to provide a quantity of the moss and/or the combustible material to boil a cup of water or cook a foil meal.

14. A method of manufacture of a composite waterproof fire starting puck, comprising:

providing a base of paraffin wax;

providing a quantity of dried waterproof or hydrophobic moss embedded in, projecting from, and surrounding the paraffin wax; and providing a quantity of combustible material in the moss;

covering the quantity of combustible material with more paraffin wax;

wherein when a spark or flame is applied to the moss, the moss ignites, and after the moss ignites the moss releases sufficient heat to ignite the quantity of combustible material, and melts and ignites the paraffin wax;

wherein the combustible material provide wicks for the paraffin wax to regulate a rate of combustion of both the quantity of combustible material and the paraffin wax.

15. The method of claim 14, further comprising providing the paraffin in a depression of a silicone tray, the depression of the silicone tray measuring about 1.5"×1.5"×1.5" (cubic inches), and then placing the moss to form a nest in the depression, and then adding the combustible material into the depression.

16. The method of claim 14, further comprising providing the moss and combustible material into a depression of a silicone tray measuring about 1.5"×1.5"×1.5" (cubic inches), and then pouring a quantity of liquid paraffin into the depression until the depression is filled with the paraffin wax.

17. The method of claim 14, further comprising adding flammable organic herbs or fragrant material to alter the smell.

18. The method of claim 14, further comprising configuring the composite waterproof fire starting puck for igniting and burning after immersion in water or other exposure to water, and for floating on water, and of igniting and burning while floating on water.

19. The method of claim 13, further comprising configuring the composite waterproof fire starting puck to be wind resistant.

20. A composite waterproof fire starting puck, comprising:

a base of paraffin wax;

a quantity of dried waterproof or hydrophobic moss embedded in, and surrounding, the paraffin wax;

a quantity of combustible material embedded in, and projecting out of, the paraffin wax and configured as wicks for the paraffin wax to regulate the rate of combustion of both the combustible material and the paraffin wax;

a wax cover; and flammable organic herbs or fragrant material to provide a smell during burning;

wherein when a spark or flame is applied to the moss, the moss ignites, and after the moss ignites, the moss releases sufficient heat to ignite the quantity of combustible material to melt and ignite the paraffin.

* * * * *